US006784781B1

(12) United States Patent
Collins et al.

(10) Patent No.: US 6,784,781 B1
(45) Date of Patent: Aug. 31, 2004

(54) REACTOR AND BALLAST SYSTEM

(75) Inventors: Byron R. Collins, Tuxedo, NC (US); George E. Kiefer, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/408,879

(22) Filed: Apr. 8, 2003

(51) Int. Cl.[7] ..... H01F 27/24
(52) U.S. Cl. ..... 336/212; 336/210
(58) Field of Search ..... 336/172, 178, 336/210, 212, 213, 216, 219, 221

(56) References Cited

U.S. PATENT DOCUMENTS 4,020,439 A 4/1977 Thiessens et al.
6,031,441 A * 2/2000 Yen ..... 336/96
6,094,124 A 7/2000 Lee

FOREIGN PATENT DOCUMENTS

EP 0 279 253 A1 1/1988
JP 62119904 A 6/1987
JP 05315162 A 11/1993

* cited by examiner

*Primary Examiner*—Ramon M. Barrera
(74) *Attorney, Agent, or Firm*—Faye, Sharpe, Fagan, Minnich & McKee, LLP

(57) ABSTRACT

An improved reactor and ballast system is provided. The reactor includes a core having an I portion and a rolled portion which forms a core opening, a coil having an electrically insulated coil opening through which the I portion extends, and a spacer between the I portion and an edge of the rolled portion of the core. A portion of the coil extends into the core opening. The ballast system includes a core having a plurality of I portions and a rolled portion which form one or more core openings, a plurality of coils, each coil having an electrically insulated coil opening through which one of the I portions extends, and a plurality of spacers between the I portions and a first edge of the rolled portion and between the I portions and a second edge of the rolled portion. A portion of each coil extends into a corresponding core opening.

15 Claims, 10 Drawing Sheets

REACTOR AND BALLAST SYSTEM

BACKGROUND OF THE INVENTION

This application relates to an electrical device, and in particular, to a reactor.

Ballasts, such as reactor ballasts, are typically used to limit the current through or stabilize the operating of various light fixtures, such as high intensity discharge (HID) lamps. Lamps have specific ballasting requirements, such as operating current at the nominal lamp voltage and maximum starting current, which affect the ballast design. Depending upon the materials used and the ballasting requirements, the design considerations include core cross-section, total air gap, lamination thickness, the dimensions of the lamination, the electrical properties of the material, the number of turns of wire, the type of wire, the cross-sectional area of the wire, the number of laminations used, and the bobbin dimensions. Thus, it would be ideal to vary any or all of these variables freely, i.e., at will with little or no penalty on tooling, for various reasons. Such reasons may include accommodating new lamp designs, new specifications on power loss, material availability, and material price fluctuations.

Typical HID reactor ballast designs are based on laminations with an "E-I" or an "E-E" structure. Bobbins or tape wound coils are used, and the bobbin or the tape serves as an electrical insulator between the magnetic wire and the steel core. Changes in the design of typical HID reactor ballasts to accommodate alternative materials or requirements may be difficult and expensive because typical HID reactor ballasts are generally very highly tooled devices that are not flexible with respect to design changes. Further, because ballast lamination and bobbin tools are generally very expensive, the initial startup manufacturing costs for reactor ballasts may be very high.

Accordingly, a need exists for a less expensive and flexible reactor ballast design.

BRIEF DESCRIPTION OF THE INVENTION

An exemplary embodiment of the invention concerns a reactor. The reactor includes a core having an I portion and a rolled portion which forms a core opening, a coil having an electrically insulated coil opening through which the I portion extends, and a spacer between the I portion and a top edge of the rolled portion of the core. A portion of the coil extends into the core opening.

An additional embodiment of the invention concerns a ballast system. The ballast system includes a core having a plurality of I portions and a rolled portion which form one or more core openings, a plurality of coils, each coil having an electrically insulated coil opening through which one of the I portions extends, and a plurality of spacers between the I portions and a first edge of the rolled portion and between the I portions and a second edge of the rolled portion. A portion of each coil extends into a corresponding core opening.

DETAILED DESCRIPTION OF THE INVENTION

Figure 1:
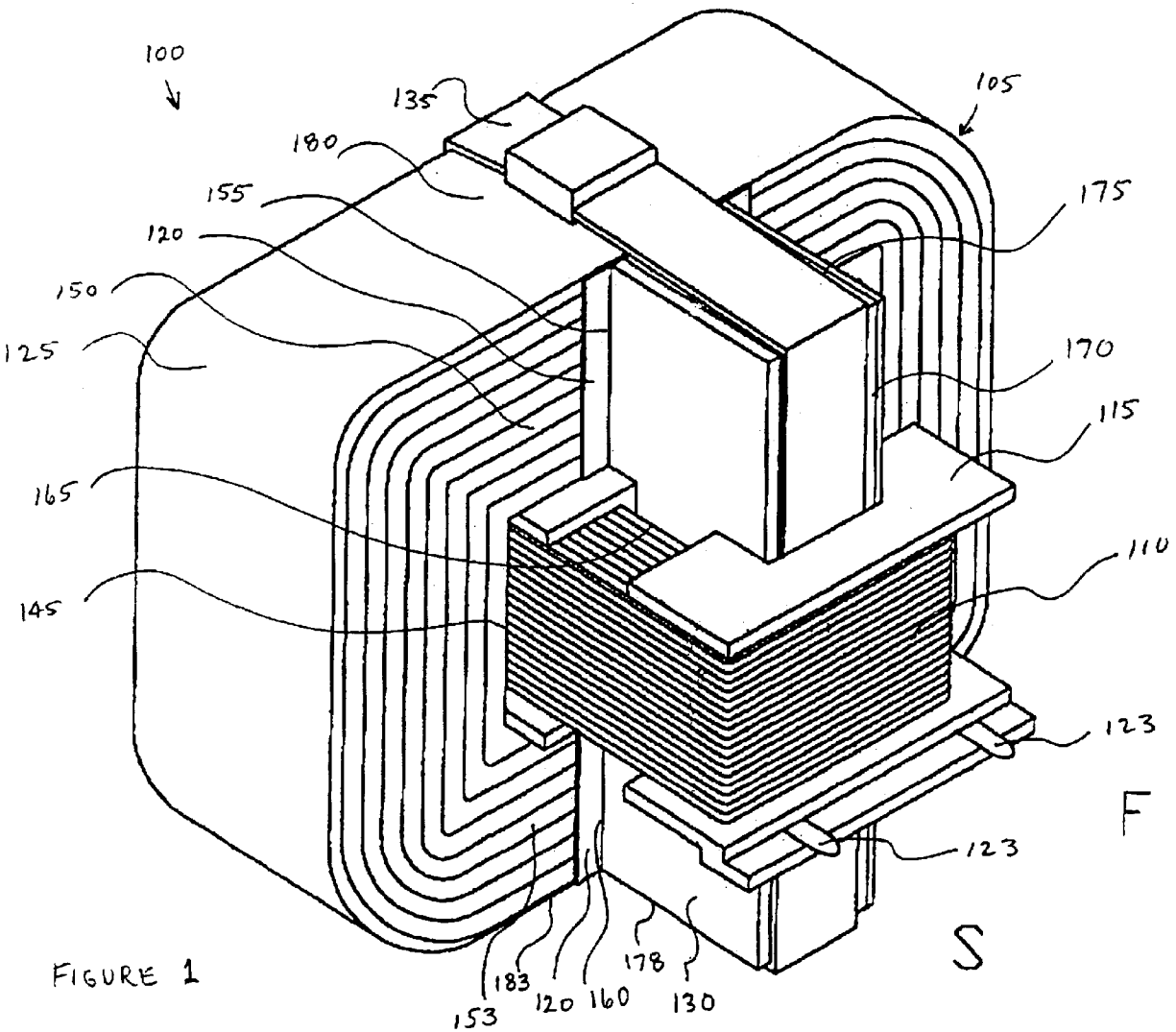
FIG. 1 is a perspective view of a reactor in one embodiment of the invention.
Figure 2:
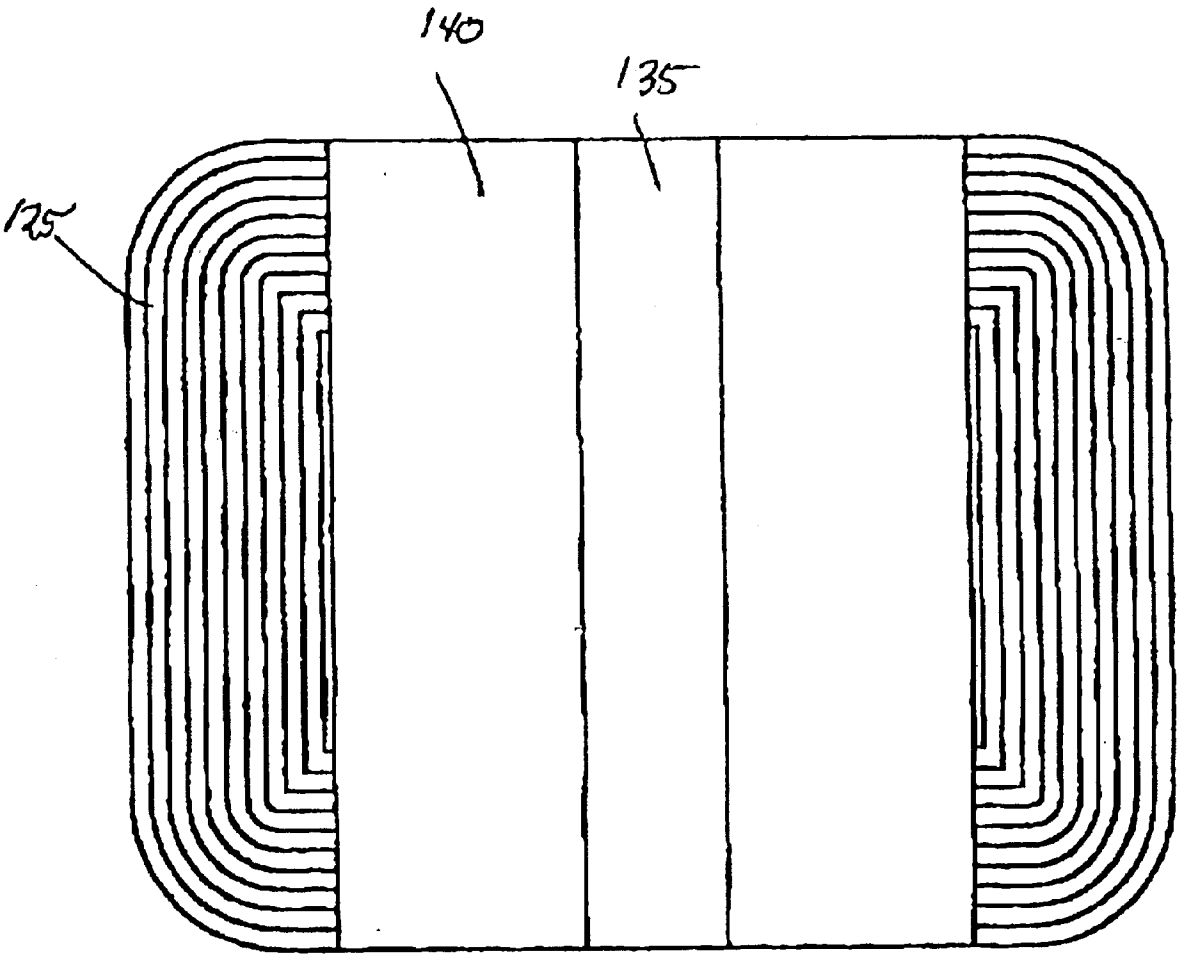
FIG. 2 is a back view of the reactor of FIG. 1.

With reference to the Figures, several embodiments of the invention are shown and will now be described. Like reference numerals are used to indicate the same element throughout the specification. FIG. 1 is a perspective view of a reactor or inductor or reactor ballast 100 in one embodiment of the invention In FIG. 1, the reactor 100 includes a core 105, a coil 110, an electrically insulative device 115, spacers 120, and electrical connection terminals 123 for the coil 110. The core 105 includes a rolled portion 125 and an I portion 130. The reactor 100 may also include a band 135, which secures the components of the reactor 100. The reactor 100 also preferably includes a plate 140 between the band 135 and the rolled portion 125, as shown in FIG. 2.

The rolled portion 125 preferably sits on the plate 140 to prevent the band 135 from warping the rolled portion 125. The plate 140 is preferably larger than the rolled portion 125. The plate 140 may be made of any material suitable for withstanding high temperatures and compressive forces without deforming or creeping, such as glass reinforced polyester.

Returning to FIG. 1, the core 105 is made of a magnetic material, such as electrical grade steel. While both the I portion 130 and rolled portion 125 of the core 105 are preferably made from the same material, the I portion 130 may be made from a different grade to accommodate the need for controlling power losses and cost. The core 105 is preferably sized to prevent the reactor 100 from exceeding the peak or highest acceptable value of flux density, which in HID lamp applications, occurs during reactor startup. Thus, the cross-sectional area of the core 105 is preferably just large enough to handle the peak flux density.

Figure 3:
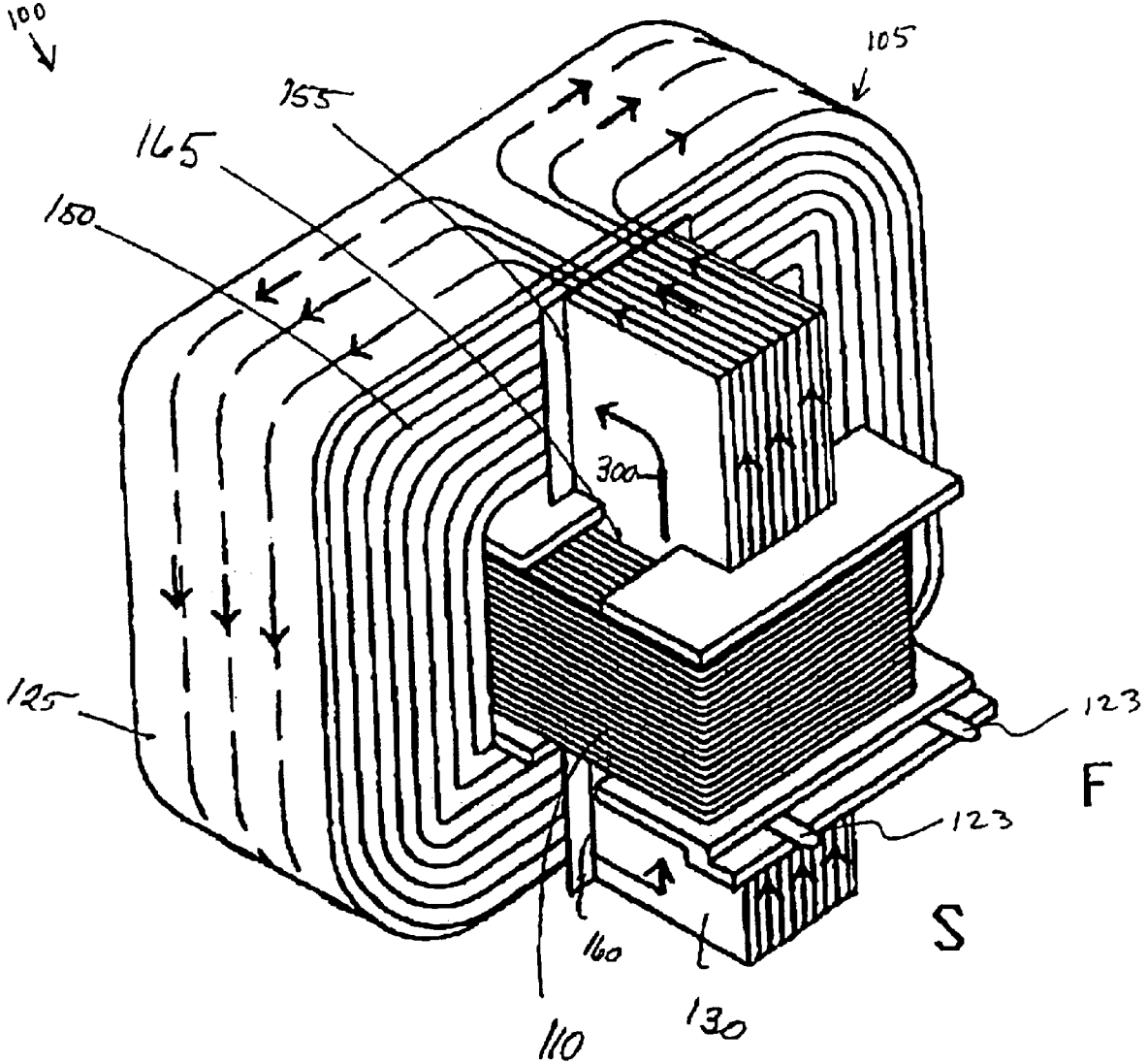
FIG. 3 is a diagram showing the magnetic flux path through the reactor of FIG. 1.

When the I portion 130 and rolled portion 125 are made of the same material, the cross-sectional area of the rolled portion 125 is preferably greater than or equal to one-half the cross-sectional area of the I portion 130. In this embodiment, the cross-sectional area around the rolled portion 125 can be capable of one-half of the peak flux density of the I portion 130 since the flux splits and goes through the rolled portion 125 in opposite directions, as shown in FIG. 3.

The amount of material energized in the core 105 is preferably minimized to reduce core losses. Core losses are comprised of Eddy losses and hysteresis losses. It is well known that Eddy current losses are much greater for a solid steel core than for a plurality of thinner stacked laminations.

Thus, a plurality of thin laminations, on the order 0.001 inch to 0.025 inch thick, are typically used for reactors operating at 60 Hz to reduce Eddy current losses.

Where the overriding design factor is the minimization of core losses, the core 105 is preferably manufactured from a very thin magnetic material which exhibits inherently low losses due to a very high resistivity. One such magnetic material is an amorphous metal sold by Allied Signal Inc. of Morristown, N.J. under the brand name METGLAS®. METGLAS® is approximately 0.001 inches thick. METGLAS®, however, may be less desirable in applications where material costs are a greater design consideration.

Returning to FIG. 1, the rolled portion 125 of the core 105 is rolled in such a manner that it forms a generally rectangular or square core opening 145. The core opening 145 is of sufficient size to receive at least a portion of the coil 110. Forming the core 105 by rolling results in a scrapless design with respect to the magnetic material since there is no wasted magnetic material that must be discarded.

The I portion 130 of the core 105 is typically a series of generally rectangular laminations forming a lamination stack. The lamination stack is preferably welded, riveted or taped together to ensure that the edge of the laminations which interface with the spacers 120 line up properly, i.e., the edge of the laminations are preferably in the same plane. The I portion 130 may be manufactured on existing equipment that can generate different dimensional lamination stacks with no additional tooling or changes in the tooling.

The laminations are preferably thin or of a very fine grain in order to achieve lower reactor losses. One limitation of thin laminations, however, is that the cost of the material per pound may increase as a result of the extra processing necessary to achieve the desired lamination thickness. Further, the density of the magnetic material will be less with thinner laminations because of the greater number of air gaps between the laminations. Thus, a greater stack height may be necessary to achieve the desired core thickness of the I portion 130.

When the reactor is assembled, the spacers 120 are located between the portion 130 and a first edge 150 of the rolled portion 125 and between the I portion 130 and a second edge 153 of the rolled portion 125. The spacers 120 create first and second air gaps 155, 160. Because the inductance of the reactor 100 is primary controlled and determined by the size of the air gaps 155, 160, the gaps 155, 160 are preferably precise and consistent.

Further, the air gaps preferably have cross-sectional areas which are at least as large as the cross-sectional area of the I portion 130, and the surface area of the air gap of the rolled portion 125 preferably is at least as large as the cross-sectional area of the air gaps. The air gaps 155, 160 are preferably freely adjusted by the choice of thickness of the material used for the spacers 120. The spacers 120 are preferably made from a flexible sheet of insulating material, such as aramid. Aramid is sold by E.I. du Pont Nemours and Company of Wilmington, Del., under the brand name NOMEX®.

The coil 110 is typically made of wire and has a predetermined number of turns. The coil 110 preferably has a coil opening 165 of sufficient size to receive the I portion 130 and the band 135. Preferably, the coil opening 165 is just large enough to tightly receive the I portion 130 and the band 135. This helps to minimize the amount of wire needed to make the coil 110 since the size of the coil opening 165 directly affects the total amount of wire needed to make the coil 110.

The coil opening 165 is electrically insulated from the I portion 130 of the core 105 by the electrically insulative device 115. The electrically insulative device 115 also holds the coil 110 together. The electrically insulative device 115 is preferably as a bobbin since it is a more precise winding form, spacer, and insulator between the I portion 130 of the core 105 and the coil 110. Further, the bobbin is preferably adjustable, which facilitates its adaptability to different reactor designs. The electrically insulative device 115, however, may alternatively be any other known device around which a coil is wound. For example, the electrically insulative device 115 may also be glue, insulating sheets, or tape applied to the coil opening 165.

In addition to securing the components of the reactor 100, the band 135 ensures that the I portion 130 of the core 105 is pressed sufficiently tight against the rolled portion 125 so that movement of the I portion 130 during energization of the reactor 100 is prevented. The band 135 is preferably a non-magnetic material, such as a non-magnetic stainless steel.

The I portion 130 and rolled portion 125 of the core 105 and the first and second air gaps 155, 160 are magnetically in series. Together, the I portion 130, the rolled portion 125, and the first and second air gaps 155, 160 form a complete magnetic path. FIG. 3 shows the path 300 of the magnetic flux which travels through the reactor 100. Current flowing through the electrical connection terminals 123 passes through the coil 110 and generates an electromotive force equal to the current times the number of turns in the coil 110. Flux travels from the I portion 130 through the first air gap 155 to the rolled portion 125, where it splits and travels in opposite directions around the rolled portion 125. Flux then travels through the second air gap 160 and back into the I portion 130.

Returning to FIG. 1, the reactor 100 is assembled as follows. The coil 110 is wound around the electrically insulative device 115 a pre-determined number of times. The I portion 130 is then inserted through the coil opening 165 such that it extends through the coil opening 165. The rolled portion 125 of the core 105 is formed by rolling the magnetic material. The spacers 120 are then placed on the first edge 150 and second edge 153 of the rolled portion 125 of the core 105 at the locations where the I portion 130 of the core 105 rests.

The coil 110 is inserted into the core opening 145 until the I portion 130 rests on the spacers 120. The components of the reactor 100 are then banded together. One end of the band 135 passes through the coil opening 165, rests on a top edge 170 of the I portion 130 and extends around first and second sides 175, 178 of the I portion 130 and first and second sides 180, 183 of the rolled portion 125, to the plate 135, where the one end of the band 135 meets a second end, The ends of the band 135 may then be secured together in any number manners known in the prior art. For example, the ends may be clipped, clamped, or crimped and heat sealed.

The reactor 100 is then preferably dipped in varnish and baked in a manner well known in the art. Varnishing the reactor 100 helps to minimize the noise and mechanical damage caused by fretting and is a preventive measure against corrosion.

Figure 4:
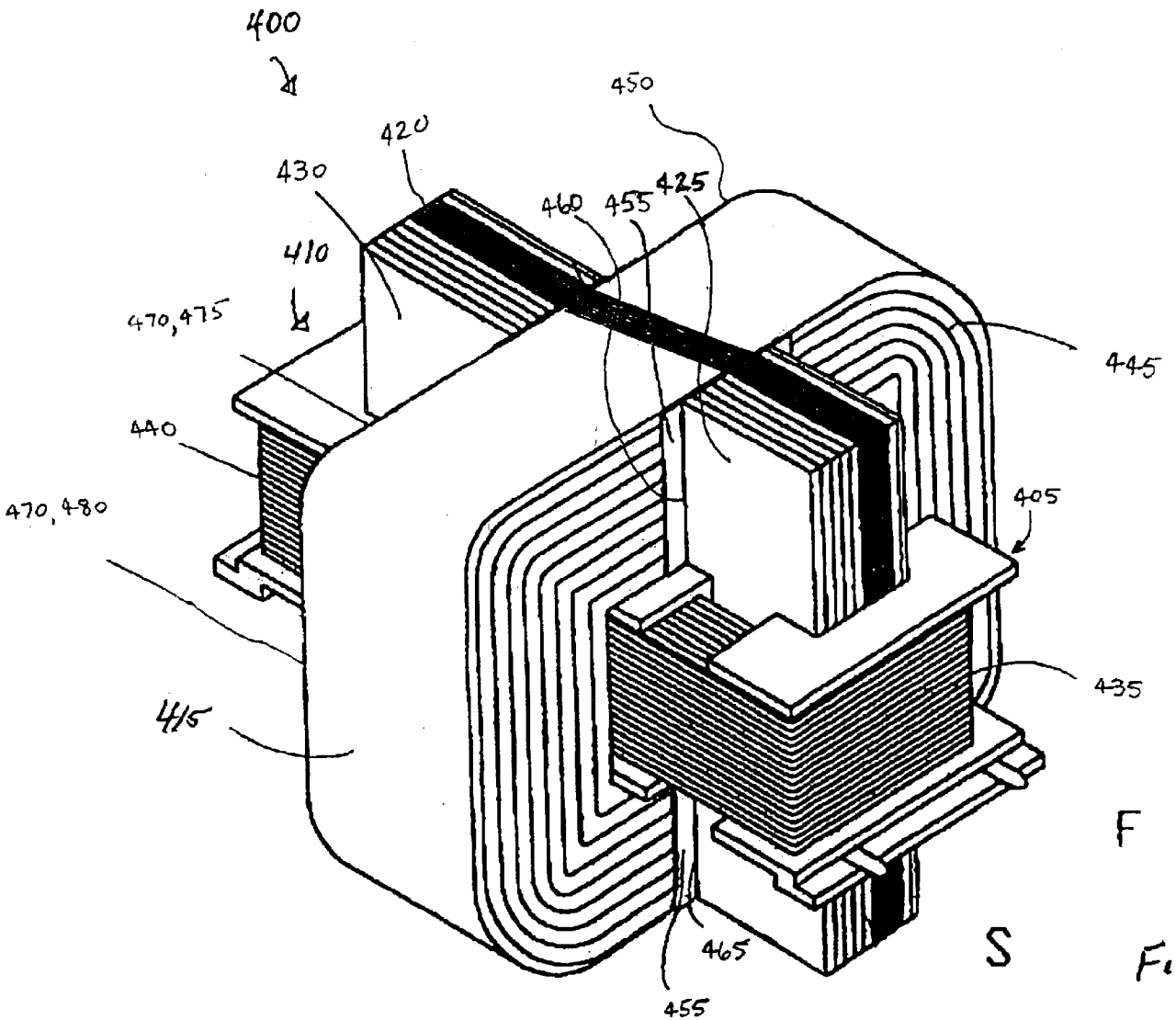
FIG. 4 is a perspective view of a ballast system in one embodiment of the invention.

FIG. 4 shows a perspective view of an embodiment of a multiple reactor ballast system 400. The ballast system 400 includes first and second reactors 405, 410. Each reactor 405, 410 contains the identical components as the reactor 100 of FIG. 1 as described above, with a few exceptions.

Instead of each reactor 405, 410 having its own rolled portion, each of the reactors 405, 410 in the ballast system 400 share a common rolled portion 415. Further, a plate is not needed since the rolled portion 415 interfaces with a small portion of a band 420, which holds the ballast system 400 together. Moreover, the core (i.e., the common rolled portion 415 and the I portions 425, 430 of each reactor 405, 410) is preferably of sufficient size for handling the peak flux density when only one of the reactors 405 or 410 is conducting current. In particular, the cross-sectional area of the common rolled portion 415 is preferably approximately one half the area of each of first and second I portions 425, 430.

The assembly of the first and second reactors 405, 410 is similar to the assembly of the reactor 100 described above. As shown in FIG. 4, the primary difference is that the first and second coils 435, 440 are placed on first and second opposing edges 445, 450 of the common rolled portion 415. First spacers 455 corresponding to the first reactor 405 create first and second air gaps 460, 465 between the corresponding first I portion 425 and the first edge 445 of the common rolled portion 415, while second spacers 470 corresponding to the second reactor 410 create first and second air gaps 475, 480 between the corresponding second I portion 430 and the second edge 450 of the common rolled portion 415. The second spacers 470 being substantially configured the same as the first spacers 455, and the second air gaps 475 and 480 being located similar to the air gaps 460, 465.

Figure 5:
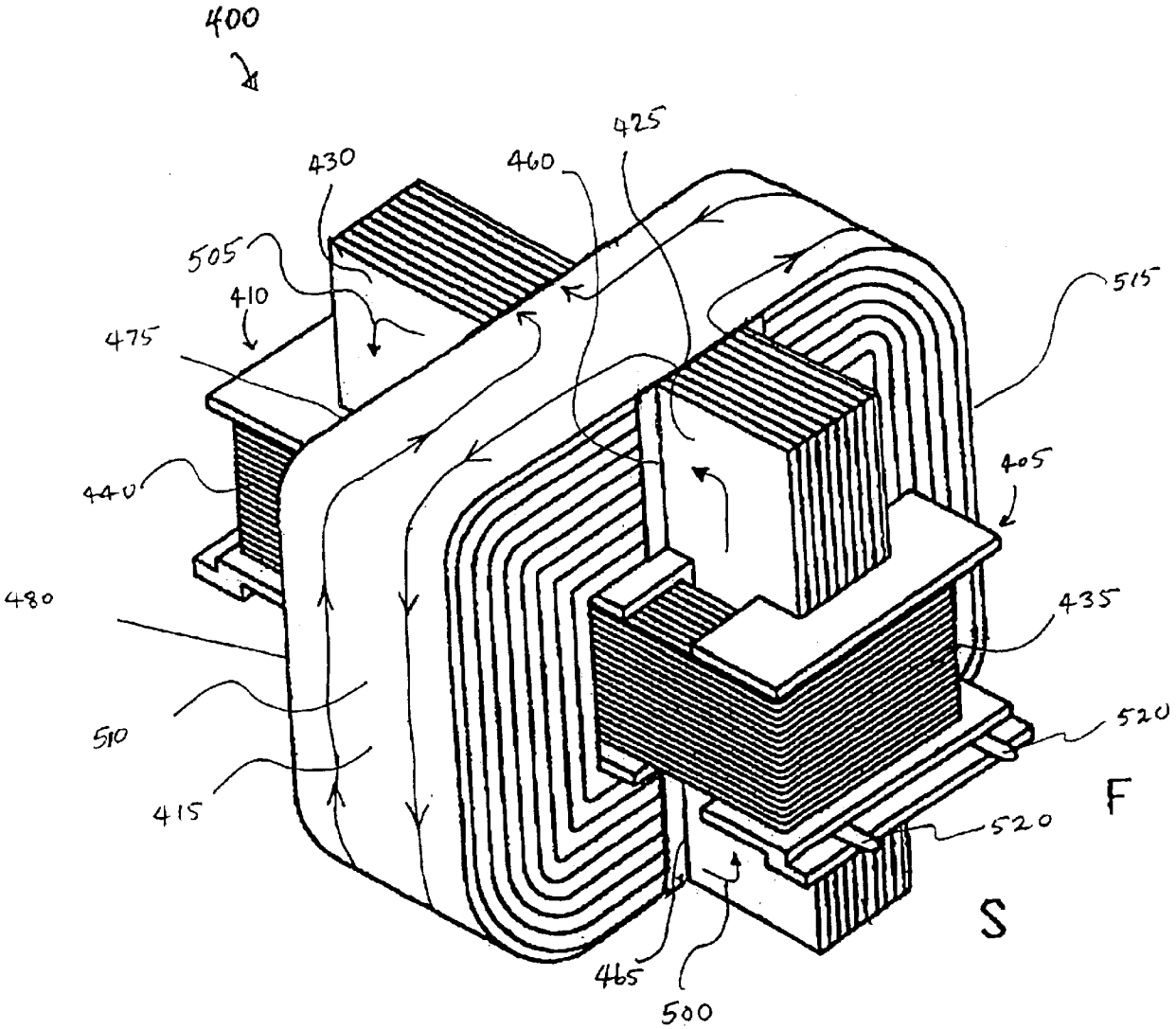
FIG. 5 is a diagram showing the magnetic flux path through the ballast system of FIG. 4.

In the multiple reactor ballast system 400, the magnetic flux through each reactor 405, 410 flows in the same manner as the magnetic flux in reactor 100 of FIG. 1. When only one reactor 405 or 410 is operating, the magnetic flux path in the ballast system.400 is the same as that depicted in FIG, 3 for a single ballast system. However, under normal circumstances both coils 435. 440 of the ballast system 400 are connected to an external circuit with the same voltage source and nearly identical loads. FIG. 5 illustrates a first flux path 500 corresponding to the first reactor 405 and a second flux path 505 corresponding to the second reactor 410 for a particular instant in time when both reactors 405, 410 are operating with essentially balanced loads and essentially equivalent voltages applied to the respective electrical connection terminals 520. Similar to the reactor 100 of FIG. 1, each coil 435, 440 of each reactor 405, 410 generates an electromotive force. Under such circumstances, the flux generated by the first coil 435 is very nearly equal to the flux generated by the second coil 440.

The flux path 500 of the first reactor 405 travels from the first I portion 425 through the first air gap 460 to the common rolled portion 415, where it splits and travels in opposite directions around the common rolled portion 415. Flux then recombines at the second air gap 465 and travels back into the first I portion 425. The flux path 505 of the second reactor 410 operates in a similar manner, with the exception that magnetic flux flows in the opposite direction of the flux path 500 of the first reactor 405. In flux path 505, flux travels from the second I portion 430 through the second air gap 480 to the common rolled portion 415, where it splits and travels in opposite directions around the common rolled portion 415. Flux then recombines at the first air gap 475 and travels back into the second I portion 430.

As shown, the two magnetic flux paths 500, 505 flow in opposite directions through the common rolled portion 415. If the flux in both coils 435, 440 are nearly the same, the flux in the rolled portion 415 will essentially cancel, except in the small volumes between the first air gaps 460, 475, and the second air gaps 465, 480. The net flux in the first and second sides 510, 515 of the common rolled portion 415 is equal to the difference of flux in the two flux paths 500, 505 passing through the particular side (i.e., 510 or 515). If the current flowing through each of the coils 420, 425 is essentially equal as a function of time, the flux generated by each coil is essentially equal, and the difference between the opposing fluxes is essentially zero. The effect of balanced flux in most of the rolled core 415 is essentially no core loss except in the portions of the core between the air gaps (460, 475; 465, 480) and the I portions (425, 430). Therefore, the core loss for both reactors operating in an essentially balanced load is less than the core loss when only one reactor is operating. Thus, a less expensive grade of material may function almost as efficiently as a higher grade of material.

Figure 6:
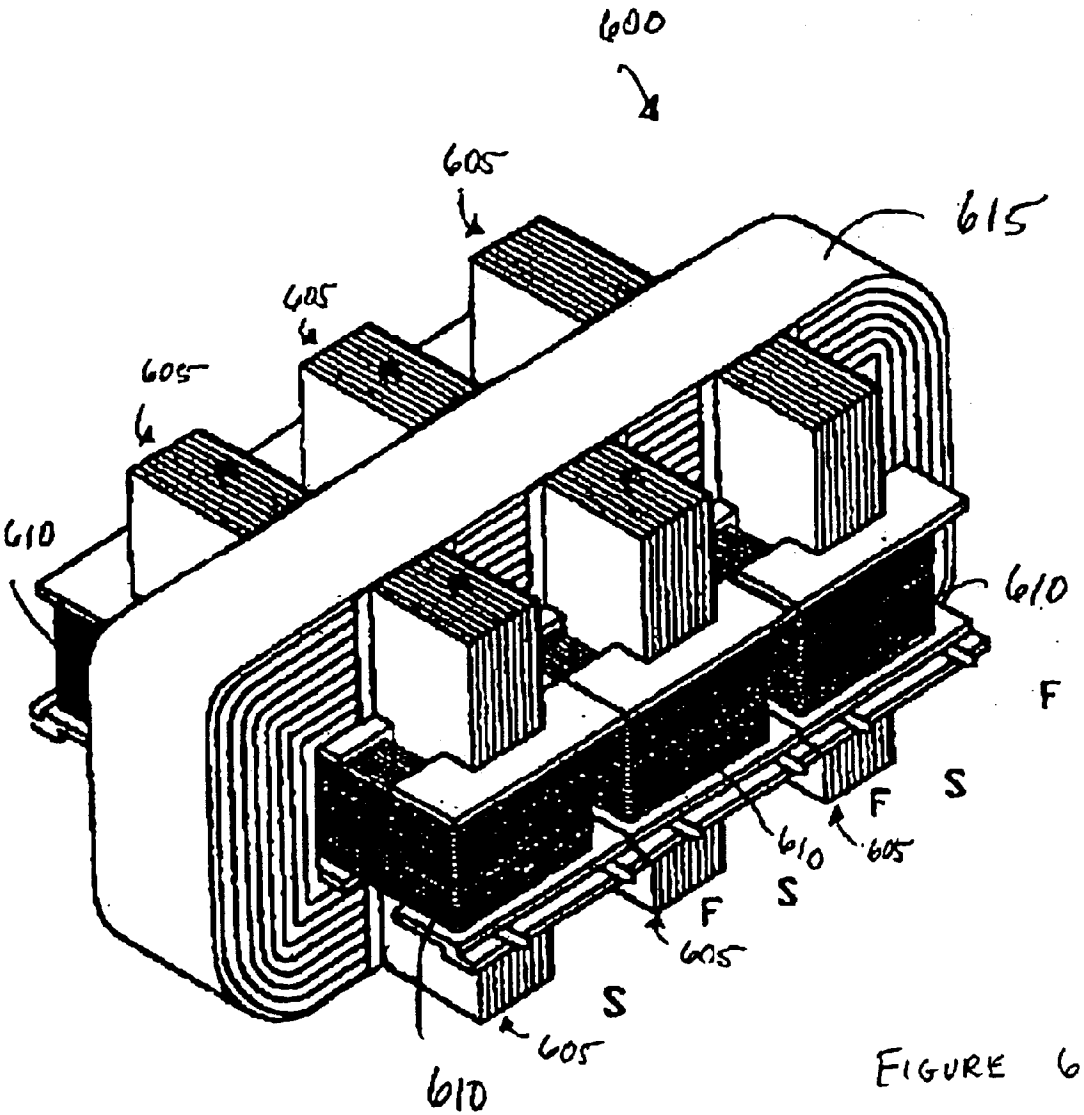
FIG. 6 is a perspective view of a second ballast system in another embodiment of the invention.

FIG. 6 shows a perspective view of a further embodiment of a multiple reactor ballast system 600. The ballast system 600 includes a plurality (six in this example) of reactors 605. For optimal performance, the ballast system 600 preferably includes an even number of reactors 605 to minimize core losses. However, ballast system 600, may support an odd number of reactors as long as the coils 610 are arranged such that the magnetic flux through the common rolled portion 615 is as low as possible. Further, the core (i.e., the common rolled portion 615 and the I portions of each reactor 605) is preferably designed in such a manner that the core will be able to handle the peak flux density when at least one of the reactors is not conducting current or operating.

Each reactor 605 in the ballast system 600, contains the identical components as the reactors 405, 410 in the ballast system 400 of FIG. 4. Further, pairs of reactors 605 are arranged identically to the reactors 405, 410 of the previously described ballast system 400. More specifically, the coils 610 are placed on opposite edges of the common rolled portion 615, as shown in FIG. 6.

Figure 7:
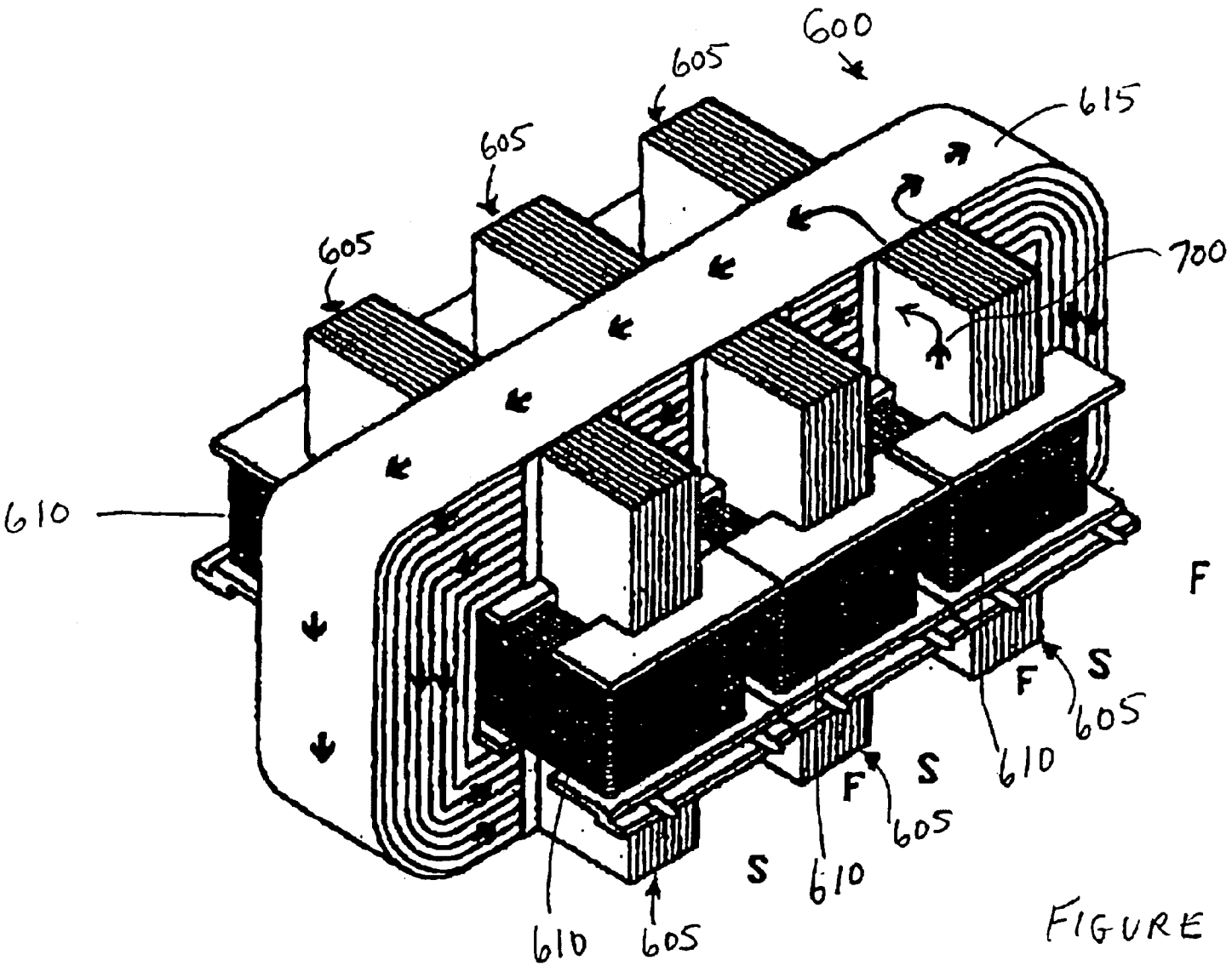
FIG. 7 is a diagram showing the magnetic flux path through a single reactor of the ballast system of FIG. 6.

When an even number of reactors 605 are operating on a single phase line, the magnetic flux in the ballast system 600 flows as in the multiple ballast system 400 of FIG. 4. When an odd number of reactors 605 are operating, as shown in FIG. 7, the flow of magnetic flux 700 through the ballast system 600 is a combination of the magnetic flux paths described for the reactor 100 of FIG. 1 and the ballast system 400 of FIG. 4. In particular, pairs of reactors 605 function as in the previously described ballast system 400 so that a minimal area of the common rolled portion 615 of the core is energized. The remaining or odd reactor 605 functions as single reactor 100, and the magnetic flux flows around the common rolled portion 615 as shown in FIG. 7.

If the multiple reactor ballast system 600, as shown in FIG. 6 (i.e., six reactors 605 arranged in three pairs with the coils 610 of each pair across the rolled portion 615 from each other), is operated on a single phase line, the cross section of the rolled portion 615 is approximately three times the cross section required for one reactor 605 to allow for worst case balance operation when three reactors 605 are not functioning. However, if the same ballast system 600 is operated on a three phase line, the cross section of the rolled portion 615 is preferably approximately twice the area compared to the area required for just one reactor 605 to operate without saturating the rolled portion 615 (i.e., compared to approximately three times the cross section of the rolled portion 615 for one reactor in single phase operation) because of the time relationship of the phases. The preferred practice in a three phase design is to operate each pair of reactors 605 (i.e., reactors positioned across the rolled portion 615 from each other) on the same phase and to connect the paired reactors 605 in a manner that when the loads are the same in the paired reactors 605, the flux flows from one paired reactor 605 to the other with minimal flux flowing around the length of the rolled portion 615. With all three phases operating with two balanced reactors 605 on each phase, the rolled portion 615 has minimal flux and minimal losses. The maximum flux density will take place if only one reactor 605 on each phase is operating, and if one of the three reactors 605 is creating a flux waveform into the rolled portion 615 that has a phase shift of 60 degrees from the other two waveforms instead of the 120 degree phase associated with the three phase voltage source.

Figure 8:
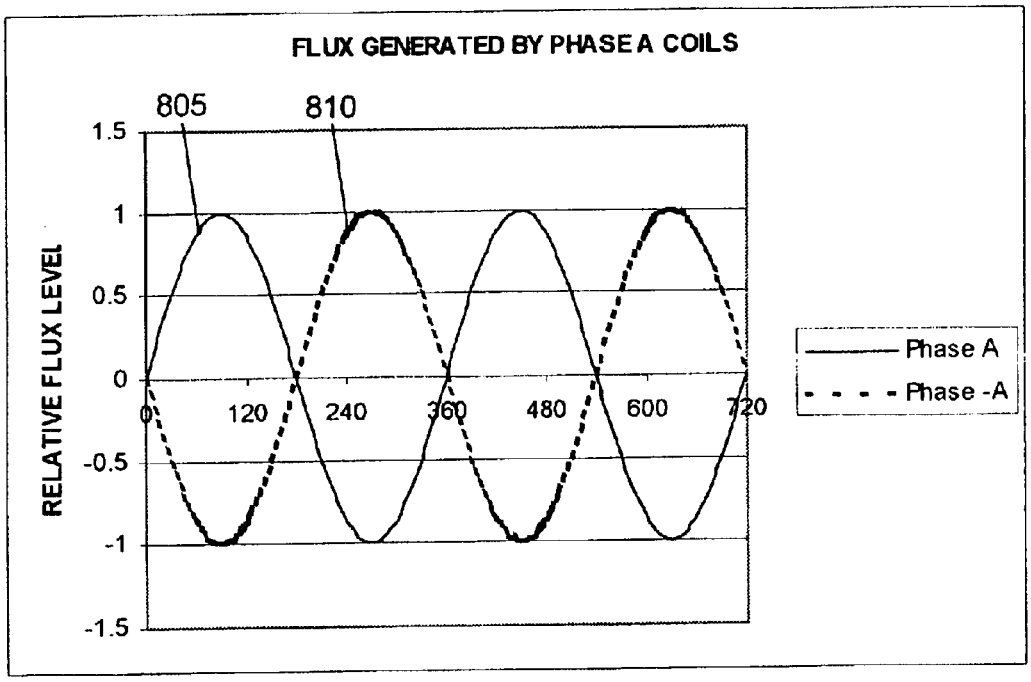
FIG. 8 is a chart showing the flux generated by phase A coils in a ballast system with three pairs of reactors, each pair operating on one phase of three phase line power.
Figure 9:
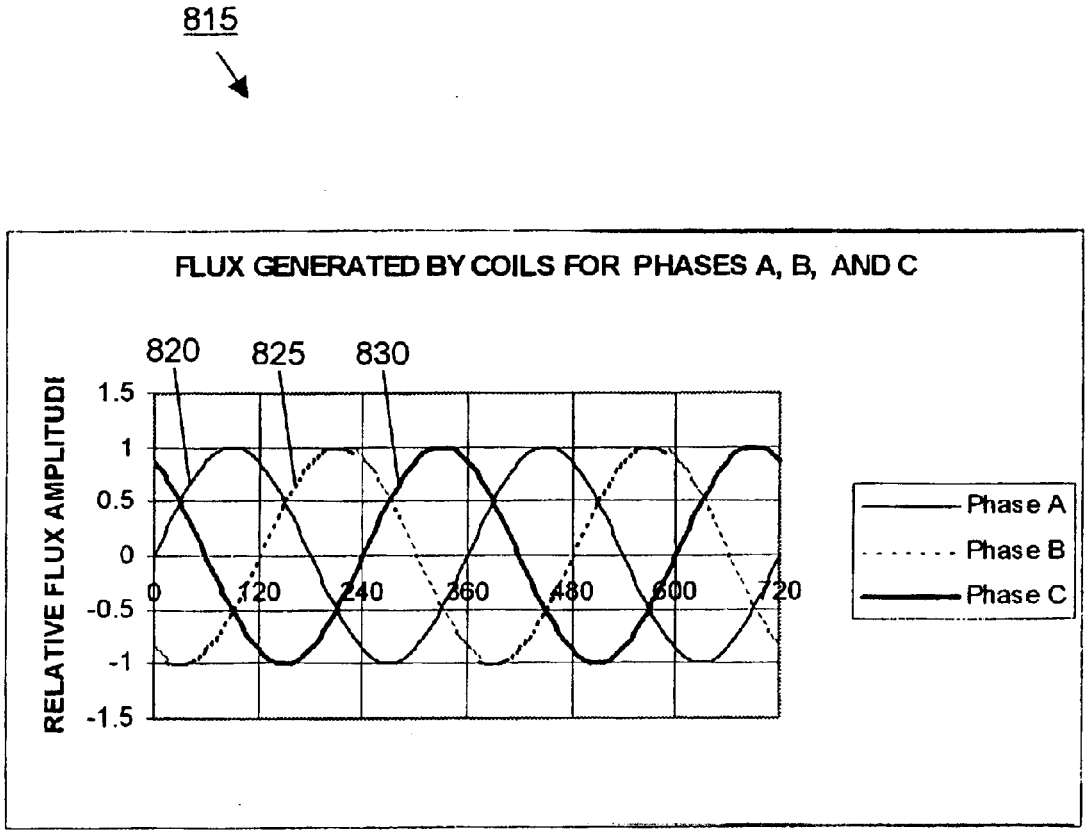
FIG. 9 is a chart showing the flux generated by coils for phases A, B, and C in a ballast system with three pairs of reactors, each pair operating on one phase of three phase line power.
Figure 10:
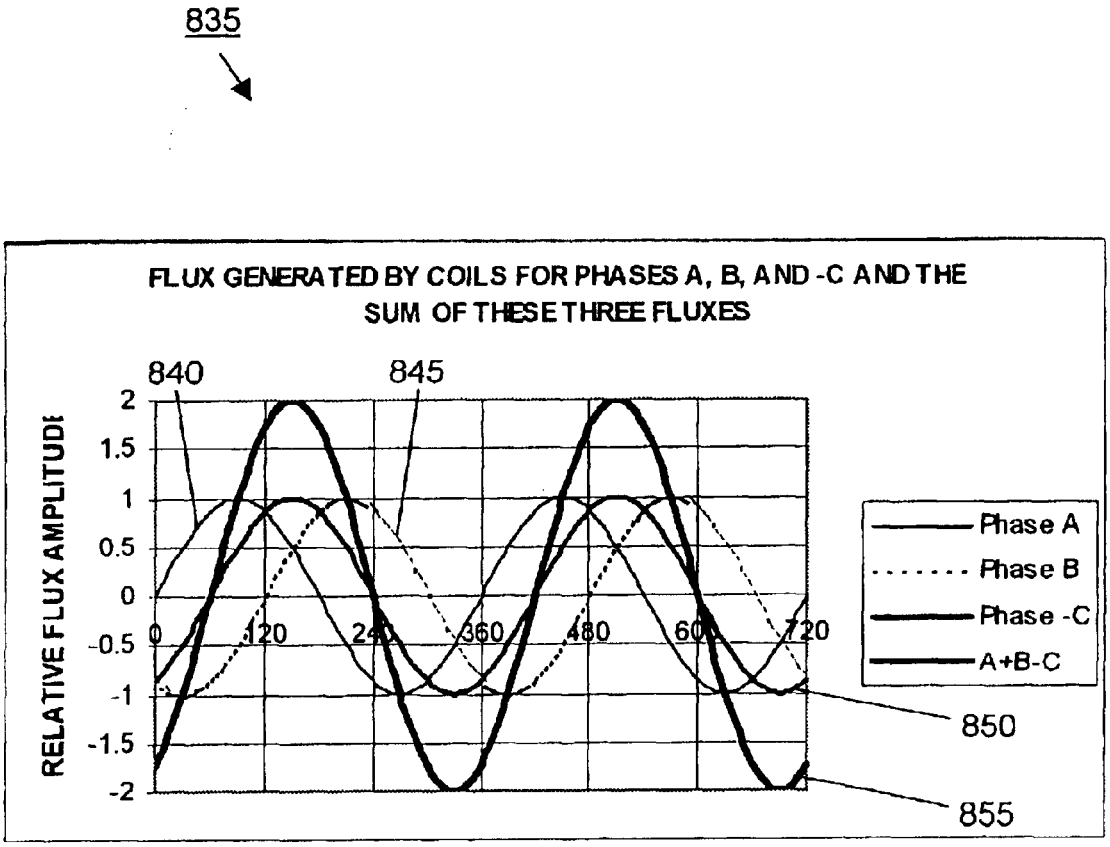
FIG. 10 is a chart showing the flux generated by coils for phases A, B, and −C in a ballast system with three pairs of reactors, each pair operating on one phase of three phase line power, along with the sum of these three coils.

Referring to FIGS. 8–10, the timing of the flux in the multiple reactor ballast system 600 of FIG. 6 in three phase operation is discussed. Each pair of reactors 605 are connected to one of the three line phases (i.e., phases A, B, and C). The flux generated by the pair of coils associated with phase A 800 of the line is represented by A 805 and −A 810 in FIG. 8. As shown, the flux generated in one coil 610 is equal and opposite to the flux in the paired coil 610 resulting in a circulating flux between the two coils with essentially no flux flowing through the circumference of the rolled portion 615. The same is true for phase B and phase C.

The phase relationship of flux generated by phases A, B, and C 815 is shown in FIG. 9. Only the positive flux directions are shown (i.e., phase A 820, phase B 825, phase C 830). If the flux in the paired coils 610 is equal and opposite to the positive fluxes, then the rolled portion 615 again sees essentially no flux through the circumference. However, if some of the loads are not present, then an unbalance of the flux occurs; the unbalanced flux flows around the circumference of the rolled portion 615. The worst case of unbalance between the flux generated by coils for phases A, B, and −C and the sum of the three fluxes 835 is illustrated in FIG. 10. As shown in this example of unbalanced flux, only the positive direction fluxes of phase A 840 and phase B 845 are flowing and only the negative direction flux of phase C 850 is flowing. The sum of these three fluxes is shown as A+B−C 855 and results in a relative maximum flux unbalance amplitude of 2. This means that the rolled portion 615 will experience twice the peak flux as compared to when one reactor 605 is operating.

During the unbalance of flux, as illustrated in FIG. 10, the unbalanced flux splits and flows in both directions in the rolled portion 615. Depending on the path length in the rolled portion 615, the flux will not necessarily split evenly, resulting in a higher flux density at on end of the rolled portion 615 compared to the other. The result is that the rolled portion 615 on one end tends to saturate more than the other. This effect is minimized by the characteristics of the rolled portion 615. Specifically, the rolled portion 615 is more reluctant to rises in flux as the flux density rises at higher flux densities. As the reluctance rises, the flux is forced to flow to the less saturated end of the rolled portion 615, preventing a saturation that would raise the reluctance, and lower the inductance of the inductors. The losses can be slightly higher, but the system will operate properly with minimal variation in the impedance of the reactors 605.

In summary, the present invention provides a simpler and low tooling cost alternative to a typical reactor design. This reactor requires dramatically less tooling and is easier to modify with minimal, if any, associated tooling costs. For example, changing dimensions or materials is easier since the design is not tied to tooled lamination dies and bobbin dimensions. Further, this reactor arrangement has fewer core losses.

Additionally, it is well known that a large air gap is susceptible to fringing, which means that some of the magnetic flux does not go through the air gap but rather takes other routes through the air, thereby increasing fringing. This reactor design has two smaller air gaps in series, which would typically have less than half the "fringing" of a double length air gap.

Furthermore, since numerous modifications and variations will readily occur to those skilled in the art, it is not desired that the present invention be limited to the exact construction and operation illustrated and described herein. Accordingly, all suitable modifications and equivalents which may be resorted to are intended to fall within the scope of the claims.

What is claimed is:

1. A reactor, comprising:

a) a core having an I portion and a rolled portion which forms a core opening;

b) a coil having an electrically insulated coil opening through which the I portion extends, a portion of the coil extending into the core opening; and c) a spacer between the I portion and an edge of the rolled portion of the core.

2. The reactor of claim 2, further comprising an electrically insulative device around which the coil is wound.

3. The reactor of claim 2, wherein the electrically insulative device is a bobbin.

4. The reactor of claim 2, wherein the electrically insulative device is tape.

5. The reactor of claim 1, further comprising a base upon which the core sits.

6. The reactor of claim 5, further comprising a band which integrally secures the core, the coil, and the base in place.

7. A ballast system, comprising:

a) a core having a plurality of I portions and a rolled portion which form one or more core openings;

b) a plurality of coils, each coil having an electrically insulated coil opening through which one of the I portions extends, a portion of each coil extending into one of the core openings; and c) a plurality of spacers between the I portions and a first edge of the rolled portion and between the I portions and a second edge of the rolled portion.

8. The ballast system of claim 7, having an even number of coils and wherein the core includes an even number of I portions.

9. The ballast system of claim 8, having two coils and wherein the core includes two I portions.

10. The ballast system of claim 7, having an odd number of coils and wherein the core includes an odd number of I portions.

11. The ballast system of claim 7, wherein the system operates with single phase line power.

12. The ballast system of claim 7, wherein the system operates with three phase line power.

13. The ballast system of claim 12, having six coils arranged in three pairs, wherein first and second coils of each pair are positioned across the rolled portion from each other, wherein a first pair of coils is operated with a first phase of the three phase line power, a second pair of coils is operated with a second phase of the three phase line power, and a third pair of coils is operated with a third phase of the three phase line power.

14. The ballast system of claim 13, wherein the cross section of the rolled portion of the ballast system operating with the three phase line power is smaller than that required by a corresponding reactor operating with single phase line power.

15. The ballast system of claim 14, wherein the savings in material to form the rolled portion of the ballast system is about 33 percent less than that required by a corresponding reactor operating with single phase line power.

* * * * *

UNITED STATES PATENT AND TRADEMARK OFFICE

CERTIFICATE OF CORRECTION

PATENT NO. : 6,784,781 B1
DATED : August 31, 2004
INVENTOR(S) : Collins et al.

It is certified that error appears in the above-identified patent and that said Letters Patent is hereby corrected as shown below:

Column 8,
Line 19, claim 2 should depend from claim 1:
2. The reactor of claim 1, further comprising an electrically insulative device around which the coil is wound.

Signed and Sealed this

Twenty-first Day of December, 2004

JON W. DUDAS
*Director of the United States Patent and Trademark Office*